US005542651A

United States Patent [19]

Kanazumi et al.

[11] Patent Number: 5,542,651

[45] Date of Patent: Aug. 6, 1996

[54] MELT DISCHARGING LAUNDER AND METALLURGICAL FURNACE INSTALLATION USING SAME

[75] Inventors: Hisao Kanazumi; Akiyoshi Yamashiro, both of Kagawa-gun, Japan

[73] Assignee: Mitsubishi Materials Corporation, Tokyo, Japan

[21] Appl. No.: 455,665

[22] Filed: May 31, 1995

Related U.S. Application Data

[63] Continuation of Ser. No. 291,489, Aug. 17, 1994, abandoned.

[30] Foreign Application Priority Data

Sep. 8, 1993 [JP] Japan ..... 5-223733

[51] Int. Cl.[6] ..... B22D 43/00

[52] U.S. Cl. ..... 266/231; 266/236

[58] Field of Search ..... 266/196, 227, 266/231, 236

[56] References Cited

U.S. PATENT DOCUMENTS 851,596 4/1907 Irvin ..... 266/196

4,300,753 11/1981 La Bate ..... 266/196

5,178,818 1/1993 Ikoma et al. ..... 266/196

*Primary Examiner*—Scott Kastler

*Attorney, Agent, or Firm*—Oblon, Spivak, McClelland, Maier & Neustadt, P.C.

[57] ABSTRACT

A launder for discharging melt from a metallurgical furnace is disclosed which includes a launder body having one end connected to the furnace. The launder body defines a fluid passageway for allowing the melt, flowing from the metallurgical furnace into the one end to flow therethrough in a direction away from the furnace. The launder body includes a threshold portion for determining the melt level in the furnace, above which the melt in the furnace begins to flow into the launder body. The launder body further includes a closing portion constructed to receive a closing material thereon to close the fluid passageway of the launder body. The closing portion is arranged at a position displaced downstream with respect to the threshold portion and has a bottom lower than the threshold portion. Additionally, a metallurgical furnace installation using the above launder is disclosed, in which a pair of the launders are arranged while ensuring space for casting or removing operations of castable.

9 Claims, 4 Drawing Sheets

MELT DISCHARGING LAUNDER AND METALLURGICAL FURNACE INSTALLATION USING SAME

This application is a continuation of application Ser. No. 08/291,489 filed on Aug. 17, 1994 now abandoned.

BACKGROUND OF THE INVENTION

1. Field of the Invention

The present invention generally pertains to a launder for discharging melt from a metallurgical furnace and a metallurgical furnace installation using the same launder. In particular, the present invention relates to an improvement in the structure of the portion at which the melt passageway is temporarily closed by casting a closing material such as a lump of castable thereon.

2. Conventional Art

FIG. 5 is a schematic cross-sectional view of a conventional melt discharging launder 1 connected to a converting furnace 2 for producing blister copper. In this known arrangement, the converting furnace 2 is constructed to have a circular furnace body 2*a* and a siphon type outlet 2*b* formed integrally therewith so as to be communicated with the furnace body 2*a*. The conventional melt-discharging launder 1 is connected at one end to outlet 2*b*, while its other end is connected to an anode furnace (not shown). Thus, melt 3, i.e., blister copper melt, which is contained in the furnace body 2*a*, is caused to overflow or siphoned out from the top of the outlet 2*b* into the launder 1 when the melt level in the furnace body 2*a* exceeds the level of the launder 1, and slag 4 floating on the melt 3 in the furnace body 2*a* is prevented from being discharged.

In the aforesaid type of melt discharging launder 1, the portion in the immediate vicinity of the top of outlet 2*b* defines a threshold portion 5 for determining the melt level in furnace 2 above which the melt 3 in the furnace begins to overflow into the launder 1. In addition, when it is necessary to temporarily close the melt passageway of the launder 1, a prescribed quantity of castable 6 or refractory material is casted on the above threshold portion 5 to dam up the melt. The castable 6 thus casted should subsequently be removed in order to permit the flow of the melt once again.

However, it has been very difficult to completely remove the castable on the threshold portion 5 because the castable 6 adheres to a bottom 5*a* thereof. As a result, the castable 6 gradually accumulates, thereby raising bottom 5*a*, such that melt level in the furnace 2, above which the melt in the furnace begins to overflow into the launder, will ultimately vary.

Moreover, inasmuch as the threshold portion 5 is arranged adjacent to the outlet 2*b*, the casting operations of the castable 6, which are performed mainly by human labor, are conducted in extremely hot environments caused by the emission of radiant heat from the melt 3, thereby rendering the operators with an excessive physical burden.

SUMMARY OF THE INVENTION

It is therefore an object of the present invention to provide a melt discharging launder which prevents a predetermined melt level in a metallurgical furnace, above which the melt in the furnace begins to overflow therefrom, from varying even when closing material, such as castable, is used to dam up the melt passageway.

Another object of the invention is to provide a metallurgical furnace installation which uses the aforesaid novel launder, and which, in particular, ensures improved working environments for the casting or removing operations of the closing material or other maintenance operations.

According to a first aspect of the present invention, there is provided a launder for discharging melt from a metallurgical furnace, comprising a launder body having one end connected to the metallurgical furnace, the launder body defining a fluid passageway for allowing the melt, flowing from the metallurgical furnace into the one end, to flow therethrough in a direction away from the metallurgical furnace; wherein the launder body includes a threshold portion for determining the melt level in the metallurgical furnace above which the melt in the furnace is caused to flow into the launder body; the launder body further includes a closing portion constructed to receive a closing material thereon to close the fluid passageway of the launder body, the closing portion being arranged at a position displaced downstream with respect to the threshold portion and having a bottom lower than the threshold portion.

In the foregoing, it is preferable that the closing portion of the launder body be constructed to have an upper wall defining a tubular melt passageway.

According to a second aspect of the present invention, there is provided a metallurgical furnace installation comprising: a metallurgical furnace; and at least one launder connected to the metallurgical furnace in fluid communication therewith for discharging melt from the metallurgical furnace; wherein the at least one launder includes a launder body having one end connected to the metallurgical furnace, the launder body defining a fluid passageway for allowing the melt, flowing from the metallurgical furnace into the one end, to flow therethrough in a direction away from the metallurgical furnace, the launder body including a threshold portion for determining melt level in the metallurgical furnace above which the melt in the furnace begins to flow into the launder body, the launder body further including a closing portion constructed to receive a closing material thereon to close the fluid passageway of the launder body, the closing portion being arranged at a position displaced downstream with respect to the threshold portion and having a bottom lower than the threshold portion.

In the foregoing, it is preferable that a pair of the launders be connected to an outlet of the furnace in fluid communication therewith, and that the pair of launders be arranged so as to extend in a direction away from each other, whereby space for work is ensured at a position adjacent to the portion from which the launders diverge. In addition, in the case where the outlet of the metallurgical furnace is formed so as to protrude outwards from the furnace body, the outlet and the pair of launders may preferably be arranged so as to assume a generally T-shape as seen in a plan view. Each of the launders may be arranged so as to define a melt passageway bent in a horizontal plane at an upstream position from the threshold portion and at a downstream position from the closing portion.

DESCRIPTION OF THE PREFERRED EMBODIMENTS OF THE INVENTION

Figure 3:
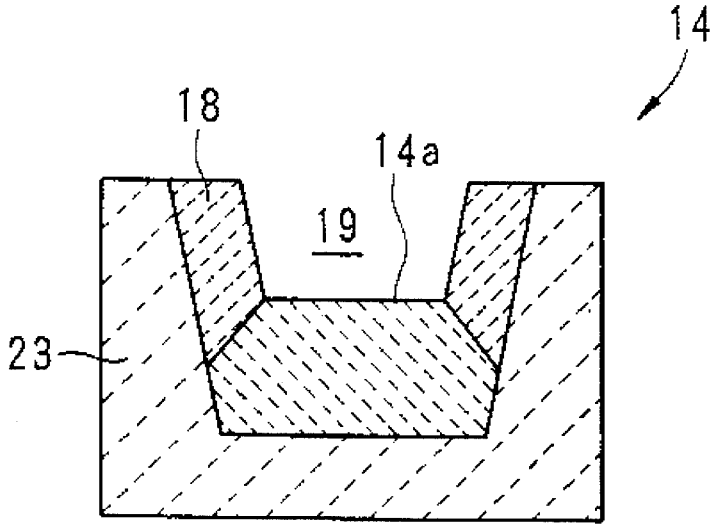
FIG. 3 is a cross-sectional view of the melt discharging launder of the installation of FIG. 1 as taken along the line III—III in FIG. 2.
Figure 4:
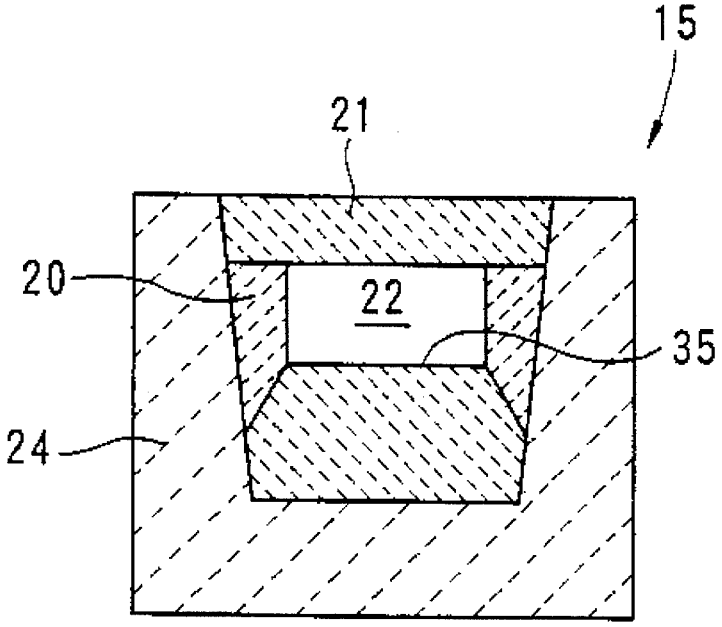
FIG. 4 is a cross-sectional view of the melt discharging launder of the installation of FIG. 1 as taken along the line IV—IV in FIG. 2.
Figure 5:
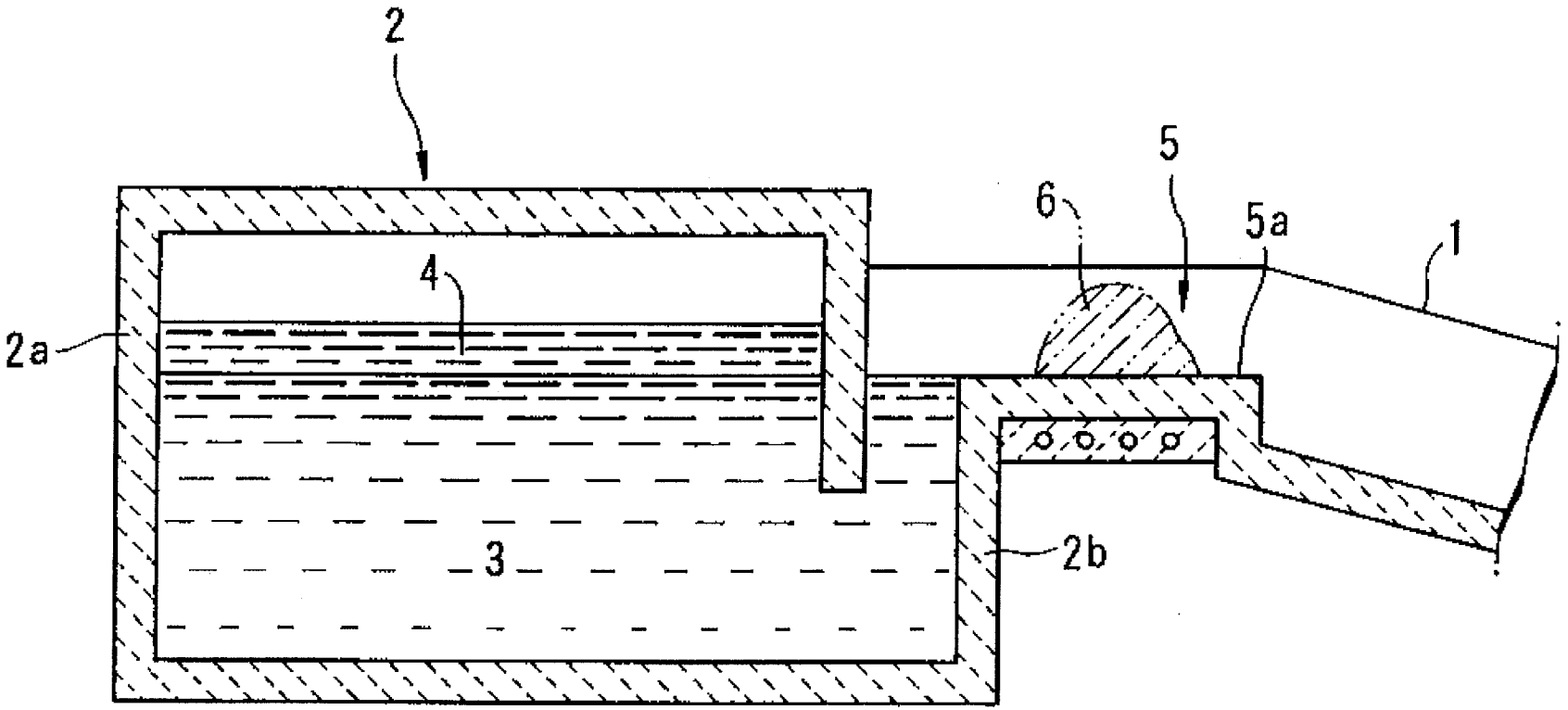
FIG. 5 is a cross-sectional view of a metallurgical furnace installation incorporating a conventional melt discharging launder.

FIGS. 1 to 4 depict a metallurgical furnace installation incorporating a melt discharging launder in accordance with the most preferred embodiment of the present invention, in which the same reference numerals are used to designate the same parts or members as in FIG. 5.

Figure 1:
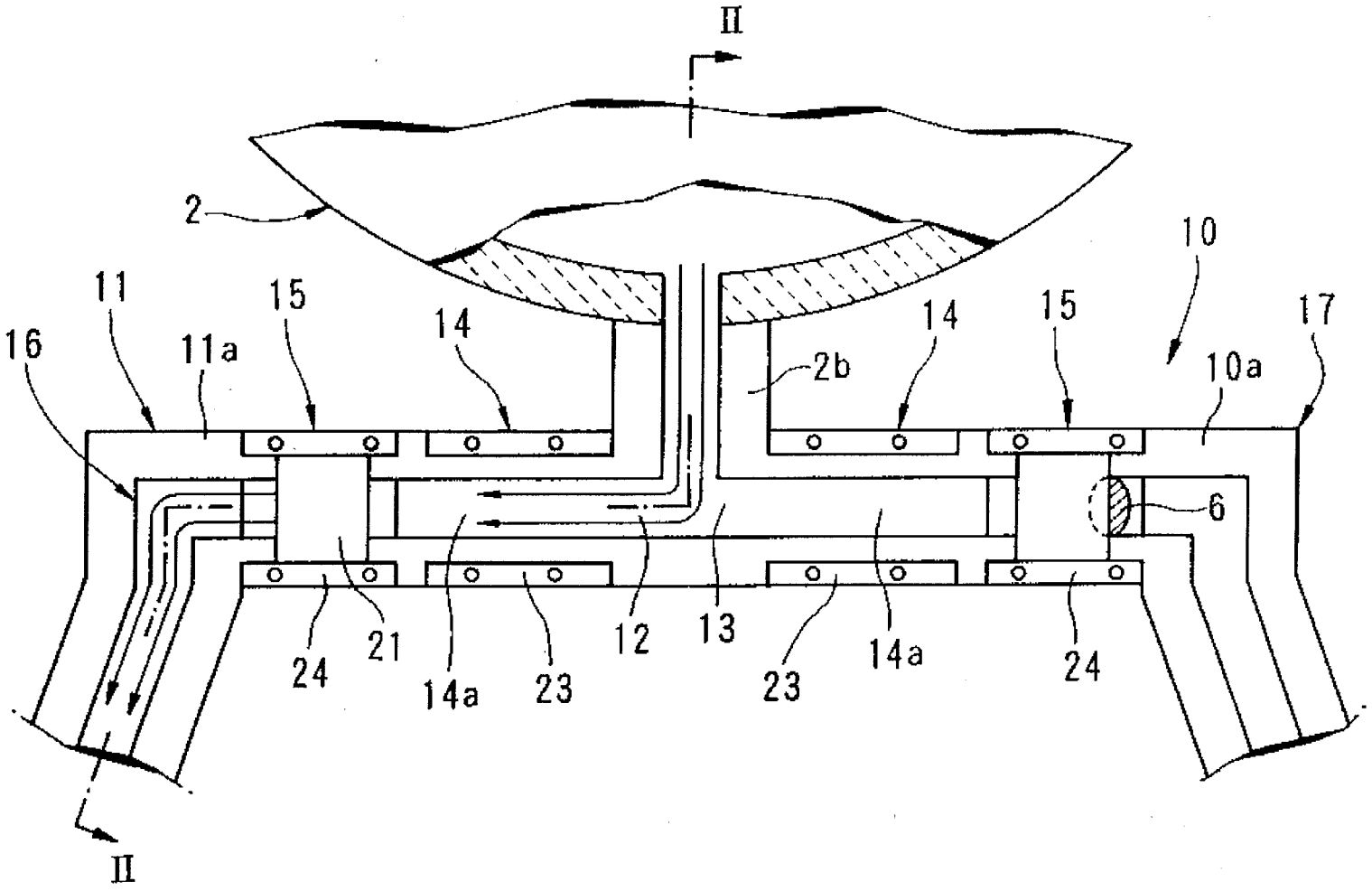
FIG. 1 is a partially cut-away plan view of a metallurgical furnace installation incorporating a melt discharging launder in accordance with the present invention.

As shown in FIG. 1, a pair of first and second melt-discharging launders, generally designated by the numerals 10 and 11, respectively, are connected to the outlet 2*b* of the furnace 2 in fluid communication therewith. Both launders 10 and 11, which are basically similar in construction to each other, are arranged so as to extend in opposite directions away from each other. More specifically, inasmuch as the outlet 2*b* of the furnace 2 is formed so as to protrude outwards from the furnace body 2*a*, the outlet 2*b* and the pair of launders 10 and 11 diverging away from each other are arranged so as to assume a generally T-shape as seen in a plan view.

Each melt discharging launder 10 or 11 includes an elongated launder body 10*a* or 11*a* having one end connected to the outlet 2*b* of the furnace 2 and the other end (not shown) connected to a respective anode furnace, and further defines a fluid passageway for allowing the melt 3, flowing from the furnace 2 into the one end, to flow therethrough in a direction away from the furnace 2 to a respective anode furnace. Due to the aforesaid T-shaped arrangement, one end of the launder 11 cooperates with the outlet 2*b* to define a melt passageway 12 bent approximately 90 degrees in a clockwise direction in a plan view, whereas one end of the launder 10 cooperates with the same outlet 2*b* to define a melt passageway 13 horizontally bent about 90 degrees in a counterclockwise direction in a plan view.

Figure 2:
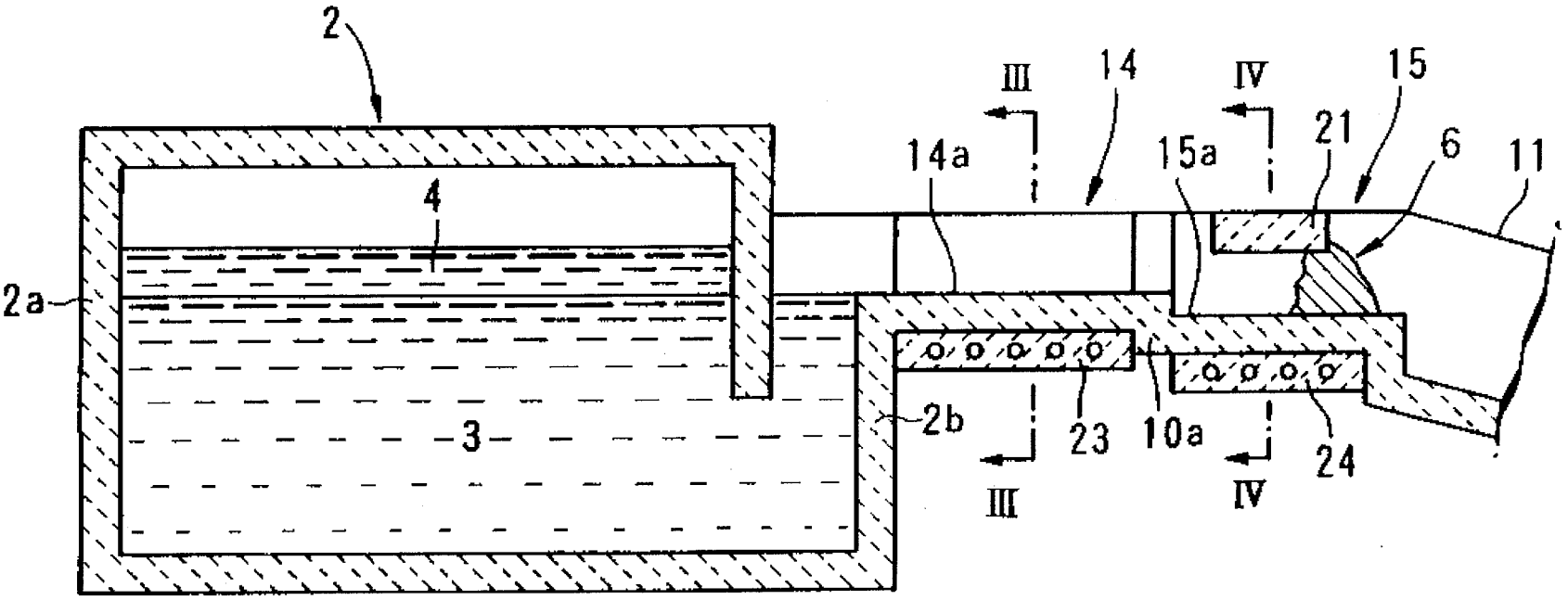
FIG. 2 is a cross-sectional view of the metallurgical furnace installation of FIG. 1 as taken along the line II—II in FIG. 1.

In each launder 10 or 11, a threshold portion 14, which functions to determine the melt level in the furnace 2, above which the melt in the furnace 2 begins to overflow into the launder body 10*a* or 11*a*, is provided adjacent to the 90 degree-bent melt passageway 12 or 13 as mentioned above. The threshold portion 14 has a generally horizontal bottom 14*a*, and when the melt level in the furnace 2 exceeds the level of the bottom 14*a*, the melt 3 in the furnace begins to overflow into the launder 10 or 11. In addition, a closing portion 15, which is constructed to receive the castable 6 (closing material) thereon to close the fluid passageway of the launder body 10*a* or 11*a*, is formed separately from the threshold portion 14 so as to be displaced in a downstream direction therefrom. As best shown in FIG. 2, the closing portion 15 has a bottom 15*a* lower than that of the threshold portion 14. With this construction, even though the castable 6 accumulates on the closing portion 15 to raise the bottom 15*a*, the melt level in the furnace 2, above which the melt 3 in the furnace 2 begins to overflow into the launder 10 or 11, would not change. Furthermore, those portions of the launder body 10*a* and 11*a* displaced from the closing portion 15 in downstream directions are further bent approximately 90 degrees in opposite directions to those of the passageways 12 and 13 in a plan view to provide further bent melt passageways 16 and 17.

Thus, space for work is ensured at a position adjacent to that portion from which the launders 10 and 11 diverge. More specifically, the area surrounded by threshold portions 14, the closing portions 15 and the bent passageways 16 and 17 of the both launders 10 and 11, serves as working space for casting or removing operations of the castable or other maintenance operations.

Moreover, as shown in FIG. 3, the threshold portion 14 is formed by refractory bricks 18 so as to define a melt passageway 19 possessing a U-shaped cross section which opens in the upward direction. Similarly, as shown in FIG. 4, the closing portion 15 is formed by refractory bricks 20, but additional bricks are used to form an upper wall 21, whereby the closing portion 15 has a melt passageway 22 of a tubular cross section. In addition, in both of the threshold and closing portions, a water cooling jacket 23 or 24, into which cooling water is supplied, is attached to the refractory bricks of the threshold and closing portions 14 and 15, to thereby prevent undue increases in temperature of the refractory bricks which, in turn, enhances durability thereof.

In the metallurgical furnace installation as described above, when the melt, contained in the converting furnace 2, is to be transferred to the anode furnace to which the first launder 10 is connected, the fluid passageway of the second launder 11 is closed by casting the castable 6 on the closing portion 15 thereof. Then, when the melt level in the furnace 2 is increased, the melt 3 in the furnace body 2*a* is caused to overflow from the top of the outlet 2*b* into both of the launders 10 and 11. However, since the fluid passageway of the second launder 11 is dammed up by the castable 6 casted thereon, the melt 3 is prevented from flowing through the second launder 11, and hence is caused to flow through only the first launder 10 to the desired anode furnace. After the completion of filling of the anode furnace with the melt 3, the castable 6 is casted on the closing portion 5 of the first launder 10 to prevent the melt 3 from flowing therethrough, while the castable 6 casted on the closing portion 15 of the second launder 11 is removed to allow the melt to flow therethrough.

In the foregoing, since the castable 6 is casted on the closing portion 15 which is separately arranged from the threshold portion 14, the castable 6 is prevented from adhering to the threshold portion 14. Therefore, variation of the melt level in the furnace 2, at which the melt in the furnace 2 begins to overflow into the launder 10 or 11, is effectively prevented. Furthermore, following a long period of operation, the castable 6 casted on the closing portion 15 might gradually accumulates thereon to raise the bottom 15*a* thereof. However, since the bottom 15*a* of the closing portion 15 is formed so as to be lower than the threshold portion 14, variation of the melt level in the furnace 2, at which the melt 3 in the furnace 2 begins to overflow into the launder, is prevented.

Moreover, since the melt passageway 22 of the closing portion 15 is formed so as to have a tubular cross-section, the casting of the castable 6 on the closing portion 15 can be performed with relative ease. In addition, since the work space is ensured at a location adjacent to the closing portions 15 by the T-shape arrangement of the launders, the above casting or removing operation can be effectively and safely carried out. Moreover, since the melt passageway 22 of the closing portion 15 is formed with a tubular shape, the radiant heat caused by the melt 3 flowing through the closing portion 15 is shielded and hence considerably weakened, so that the working environments can be further improved.

Obviously, many modifications and variations of the present invention are possible in the light of the above teachings. For example, in the foregoing, although the metallurgical furnace illustrated is a converting furnace for producing blister copper from matte, the furnace could be any other type of furnace that can be used in the metallurgical facility. The structure of the furnace may thus be modified arbitrarily. The number of the melt discharging launders connected to the furnace may also be optionally determined.

Finally, the present application claims the priority of Japanese Patent Application No. 5-223733 filed Sep. 8, 1993, which is herein incorporated by reference.

What is claimed is:

1. A launder for discharging melt from a metallurgical furnace, comprising:

a launder body having one end connected to said metallurgical furnace, said launder body defining a fluid passageway for allowing the melt, flowing from said metallurgical furnace into said one end, to flow therethrough in a direction away from said metallurgical furnace;

wherein said launder body includes a threshold portion having a substantially horizontal threshold portion bottom which is positioned to determine a melt level in said metallurgical furnace above which the melt in the furnace begins to flow into the launder body, said launder body further including a closing portion having a substantially horizontal closing portion bottom for receiving a closing material thereon to close the fluid passageway of said launder body, said closing portion being arranged at a position displaced downstream in a direction of a melt flow with respect to said threshold portion, and said closing portion bottom being lower than said threshold portion bottom such that a stepped portion connects said threshold portion bottom and said closing portion bottom;

said melt discharging launder further comprising a solid castable as the closing material positioned on said closing portion bottom.

2. A melt discharging launder as defined in claim 1, wherein said closing portion of said launder body is constructed to have an upper wall defining a tubular melt passageway.

3. A metallurgical furnace installation comprising:

a metallurgical furnace; and at least one launder connected to said metallurgical furnace in fluid communication therewith for discharging melt from said metallurgical furnace;

wherein said at least one launder includes a launder body having one end connected to said metallurgical furnace, said launder body defining a fluid passageway for allowing the melt, flowing from said metallurgical furnace into said one end, to flow therethrough in a direction away from said metallurgical furnace, said launder body including a substantially horizontal threshold portion for determining a melt level in said metallurgical furnace above which the melt in the furnace begins to flow into the launder body, said launder body further including a substantially horizontal closing portion constructed to receive a closing material thereon to close the fluid passageway of said launder body, said closing portion being arranged at a position displaced downstream with respect to said threshold portion and having a bottom lower than said threshold portion;

said melt discharging launder further comprising a solid castable as the closing material positioned on said closing portion of one of said first and second launders.

4. A metallurgical furnace installation according to claim 3, wherein said metallurgical furnace includes a furnace body and an outlet, and said metallurgical furnace installation comprises first and second launders connected to said outlet of said furnace in fluid communication therewith, said first and second launders are arranged so as to extend in a direction away from each other, whereby space for work is ensured at a position adjacent to that portion from which said launders diverge.

5. A metallurgical furnace installation according to claim 4, wherein said outlet of said metallurgical furnace is formed so as to protrude outwards from said furnace body; and wherein said outlet and said first and second launders are arranged so as to assume a generally T-shape as viewed in plan.

6. A metallurgical furnace installation according to claim 4, wherein each of said launders is arranged so as to define a melt passageway bent in a horizontal plane at an upstream position from said threshold portion and at a downstream position from said closing portion.

7. A metallurgical furnace installation according to claim 3, wherein said closing portion of said launder body of each launder is constructed to have an upper wall defining a tubular melt passageway.

8. A launder for discharging melt from a metallurgical furnace, comprising:

a launder body having one end connected to said metallurgical furnace, said launder body defining a fluid passageway for allowing the melt, flowing from said metallurgical furnace into said one end, to flow therethrough in a direction away from said metallurgical furnace;

wherein said launder body includes a threshold portion having a horizontal threshold portion bottom which is positioned to determine a melt level in said metallurgical furnace above which the melt in the furnace begins to flow into the launder body, said launder body further including a closing portion having a horizontal closing portion bottom for receiving a closing material thereon to close the fluid passageway of said launder body, said closing portion being arranged at a position displaced downstream in a direction of a melt flow with respect to said threshold portion, and said closing portion bottom being lower than said threshold portion bottom such that a stepped portion connects said threshold portion bottom and said closing portion bottom.

9. A metallurgical furnace installation comprising:

a metallurgical furnace; and at least one launder connected to said metallurgical furnace in fluid communication therewith for discharging melt from said metallurgical furnace;

wherein said at least one launder includes a launder body having one end connected to said metallurgical furnace, said launder body defining a fluid passageway for allowing the melt, flowing from said metallurgical furnace into said one end, to flow therethrough in a direction away from said metallurgical furnace, said launder body including a horizontal threshold portion for determining a melt level in said metallurgical furnace above which the melt in the furnace begins to flow into the launder body, said launder body further including a horizontal closing portion constructed to receive a closing material thereon to close the fluid passageway of said launder body, said closing portion being arranged at a position displaced downstream with respect to said threshold portion and having a bottom lower than said threshold portion.

* * * * *